US007181389B2

(12) United States Patent
Liljeryd et al.

(10) Patent No.: US 7,181,389 B2
(45) Date of Patent: Feb. 20, 2007

(54) EFFICIENT SPECTRAL ENVELOPE CODING USING VARIABLE TIME/FREQUENCY RESOLUTION AND TIME/FREQUENCY SWITCHING

(75) Inventors: Lars Gustaf Liljeryd, Solna (SE); Kristofer Kjörling, Solna (SE); Per Ekstrand, Stockholm (SE); Fredrik Henn, Bromma (SE)

(73) Assignee: Coding Technologies AB (SE)

( * ) Notice: Subject to any disclaimer, the term of this patent is extended or adjusted under 35 U.S.C. 154(b) by 0 days.

(21) Appl. No.: 11/246,283

(22) Filed: Oct. 11, 2005

(65) Prior Publication Data

US 2006/0031064 A1 Feb. 9, 2006

Related U.S. Application Data

(62) Division of application No. 09/763,128, filed as application No. PCT/SE00/00158 on Jan. 26, 2000, now Pat. No. 6,978,236.

(30) Foreign Application Priority Data

Oct. 1, 1999 (SE) ..... 9903552

(51) Int. Cl.
*G10L 21/00* (2006.01)

(52) U.S. Cl. ..... 704/219; 704/200; 704/500

(58) Field of Classification Search ..... 704/219, 704/200, 500

See application file for complete search history.

(56) References Cited

U.S. PATENT DOCUMENTS 5,394,473 A 2/1995 Davidson
5,504,832 A 4/1996 Taguchi
5,581,653 A 12/1996 Todd
5,651,089 A 7/1997 Teh
5,737,718 A 4/1998 Tsutsui
5,852,806 A 12/1998 Johnston et al.
6,115,684 A 9/2000 Kawahara et al.
6,141,353 A * 10/2000 Li ..... 370/465
6,658,382 B1 * 12/2003 Iwakami et al. ..... 704/224
6,744,784 B1 * 6/2004 Naka et al. ..... 370/476

FOREIGN PATENT DOCUMENTS

JP 10-39897 2/1989

(Continued)

OTHER PUBLICATIONS

Schultz, D., "Improving Audio Codecs by Noise Substitution,", 1996, pp. 593-598, JAES, vol. 44, No. 7/8.

(Continued)

*Primary Examiner*—Daniel Abebe
(74) *Attorney, Agent, or Firm*—Michael A. Glenn; Glenn Patent Group

(57) ABSTRACT

The present invention provides a new method and an apparatus for spectral envelope encoding. The invention teaches how to perform and signal compactly a time/frequency mapping of the envelope representation, and further, encode the spectral envelope data efficiently using adaptive time/frequency directional coding. The method is applicable to both natural audio coding and speech coding systems and is especially suited for coders using SBR [WO 98/57436] or other high frequency reconstruction methods.

14 Claims, 6 Drawing Sheets

FOREIGN PATENT DOCUMENTS

| | | |
|---|---|---|
| JP | 10190498 | 7/1998 |
| JP | 11242499 | 9/1999 |
| WO | WO-98/52187 | 11/1998 |
| WO | WO-98/57436 | 12/1998 |
| WO | WO-99/22451 | 5/1999 |

OTHER PUBLICATIONS

Oxenham, A.J. et al., "Modeling the Additivity of Nonsimultaneous Masking," 1994, Hearing Res., vol. 80, pp. 105-118.

J. Princen and J.D. Johnston; Audio Coding With Signal Adaptive Filterbanks; 1995 International Conference on Acoustics, Speech and Signal Processing, IDASSP-95; May 1995; pp. 3071-3074, vol. 5.

Marina Bosi, Grant Davidson, Louis Fielder; Time Versus Frequency in a Low-Rate, High Quality Audio Transform Coder; 1991 IEEE ASSP Workshop on Applications of Signal Processing ot Audio and Acoustics, Final Program and Paper Summaries, pp. 8_81-0_82.

* cited by examiner

EFFICIENT SPECTRAL ENVELOPE CODING USING VARIABLE TIME/FREQUENCY RESOLUTION AND TIME/FREQUENCY SWITCHING

This application is a Divisional of co-pending application Ser. No. 09/763,128 filed on May 15, 2001 now U.S. Pat. No. 6,978,236 and for which priority is claimed under 35 U.S.C. § 120. Application Ser. No. 09/763,128 is the national phase of PCT International Application No. PCT/SE00/00158 filed on Jan. 26, 2000, under 35 U.S.C. § 371, and which designated the United States of America. PCT International Application No. PCT/SE00/00158 claims priority under 35 U.S.C. § 119(a) on Patent Application No. 9903552-9 filed in Sweden on Oct. 1, 1999. The entire contents of each of the above-identified applications are hereby incorporated by reference.

TECHNICAL FIELD

The present invention relates to a new method and apparatus for efficient coding of spectral envelopes in audio coding systems. The method may be used both for natural audio coding and speech coding and is especially suited for coders using SBR [WO 98/57436] or other high frequency reconstruction methods.

BACKGROUND OF THE INVENTION

Audio source coding techniques can be divided into two classes: natural audio coding and speech coding. Natural audio coding is commonly used for music or arbitrary signals at medium bitrates, and generally offers wide audio bandwidth. Speech coders are basically limited to speech reproduction but can on the other hand be used at very low bitrates, albeit with low audio bandwidth. In both classes, the signal is generally separated into two major signal components, the "spectral envelope" and the corresponding "residual" signal. Throughout the following description, the term "spectral envelope" refers to the coarse spectral distribution of the signal in a general sense, e.g. filter coefficients in an linear prediction based coder or a set of time-frequency averages of subband samples in a subband coder. The term "residual" refers to the fine spectral distribution in a general sense, e.g. the LPC error signal or subband samples normalized using the above time-frequency averages. "Envelope data" refers to the quantized and coded spectral envelope, and "residual data" to the quantized and coded residual. At medium and high bitrates, the residual data constitutes the main part of the bitstream. At very low bitrates, the envelope data constitutes a larger part of the bitstream. Hence, it is indeed important to represent the spectral envelope compactly when using lower bitrates.

Prior art audio coders and most speech coders use constant length, relatively short, time segments in the generation of envelope data to achieve good temporal resolution. However, this prevents optimal utilisation of the frequency domain masking known from psycho-acoustics. To improve coding gain through the use of narrow filterbands with steep slopes, and still achieve good temporal resolution during transient passages, modern audio coders employ adaptive window switching, i.e. they switch time segment lengths depending on the signals statistics. Clearly a minimum usage of the short segments is a prerequisite for maximum coding gain. Unfortunately, long transition windows are needed to alter the segment lengths, limiting the switching flexibility.

The spectral envelope is a function of two variables: time and frequency. The encoding can be done by exploiting redundancy in either direction of the time/frequency plane. Generally, coding of the spectral envelope is performed in the frequency direction, using delta coding (DPCM) or vector quantization (VQ).

SUMMARY OF THE INVENTION

The present invention provides a new method, and an apparatus for spectral envelope coding. The coding scheme is designed to meet the special requirements of systems, where the residual signal within certain frequency regions is excluded from the transmitted data. Examples are systems employing HFR (High Frequency Reconstruction), in particular SBR (Spectral Band Replication), or parametric coders. In one implementation, non-uniform time and frequency sampling of the spectral envelope is obtained by adaptively grouping subband samples from a fixed size filterbank, into frequency bands and time segments, each of which generates one envelope sample. This allows instantaneous selection of arbitrary time and frequency resolution within the limits of the filterbank. The system defaults to long time segments and high frequency resolution. In the vicinity of transients, shorter time segments are used, whereby larger frequency steps can be used in order to keep the data size within limits. In order to maximize the benefits of the non-uniform sampling in time, variable length of bitstream frames or granules are used. The variable time/frequency resolution method is also applicable on envelope encoding based on prediction. Instead of grouping of subband samples, predictor coefficients are generated for time segments of varying lengths according to the system.

The invention describes two schemes for signalling of the time and frequency resolution used. The first scheme allows arbitrary selection, by explicit signalling of time segment borders and frequency resolutions. In order to reduce the signalling overhead, four classes of granules are used, offering different cost/flexibility tradeoffs. The second scheme exploits the property of a typical programme material, that transients are separated at least by a time $T_{nmin}$, in order to reduce the number of control bits further. Hereby, a transient detector in the encoder, operating on a time interval $T_{det}<=T_{nmin}$, equal to the nominal granule length, determines the position of the onset of a possible transient. The position within the interval is encoded and sent to the decoder. The encoder and decoder share rules that specify the time/frequency distribution of the spectral envelope samples, given a certain combination of subsequent control signals, ensuring an unambiguous decoding of the envelope data.

The present invention presents a new and efficient method for scalefactor redundancy coding. A dirac pulse in the time domain transforms to a constant in the frequency domain, and a dirac in the frequency domain, i.e. a single sinusoid, corresponds to a signal with constant magnitude in the time domain. Simplified, on a short term basis, the signal shows less variations in one domain than the other. Hence, using prediction or delta coding, coding efficiency is increased if the spectral envelope is coded in either time- or frequency-direction depending on the signal characteristics.

BRIEF DESCRIPTION OF THE DRAWINGS

The present invention will now be described by way of illustrative examples, not limiting the scope or spirit of the invention, with reference to the accompanying drawings, in which.

DESCRIPTION OF PREFERRED EMBODIMENTS

The below-described embodiments are merely illustrative for the principles of the present invention for efficient envelope coding. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

Generation of Envelope Data

Figure 1A:
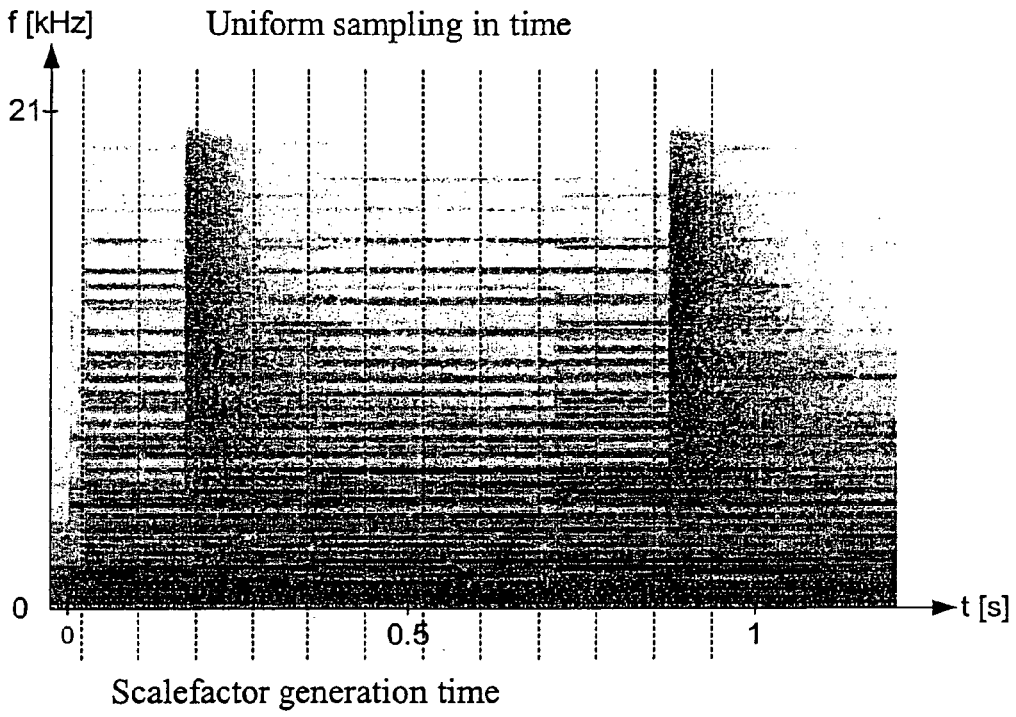
FIGS. 1*a*–1*b* illustrate uniform respective non-uniform sampling in time of the spectral envelope.
Figure 1B:
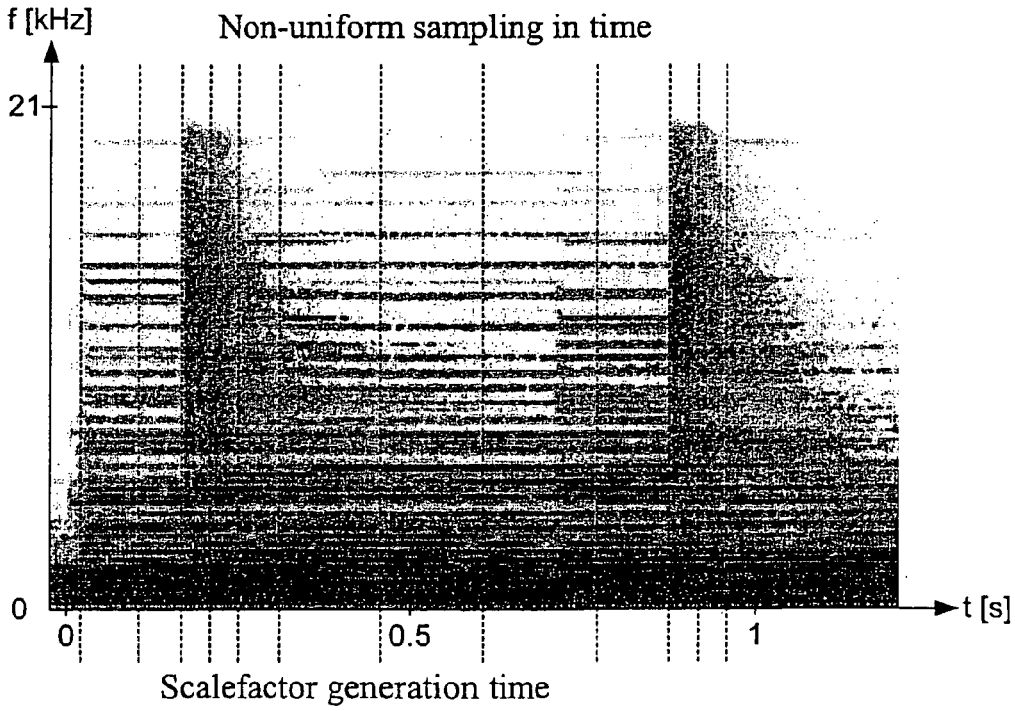

Most audio and speech coders have in common that both envelope data and residual data are transmitted and combined during the synthesis at the decoder. Two exceptions are coders employing PNS ["Improving Audio Codecs by Noise Substitution", D. Schultz, JAES, vol. 44, no. 7/8, 1996], and coders employing SBR. In case of SBR, considering the highband, only the spectral coarse structure needs to be transmitted since a residual signal is reconstructed from the lowband. This puts higher demands on how to generate envelope data, in particular due to lack of "timing" information contained in the original residual signal. This problem will now be demonstrated by means of an example:

FIG. 1 shows the time/frequency representation of a musical signal where sustained chords are combined with sharp transients with mainly high frequency contents. In the lowband the chords have high power and the transient power is low, whereas the opposite is true in the highband. The envelope data that is generated during time intervals where transients are present is dominated by the high intermittent transient power. At the SBR process in the decoder, the spectral envelope of the transposed signal is estimated using the same instantaneous time-/frequency resolution as used for the analysis of the original highband. An equalization of the transposed signal is then performed, based on dissimilarities in the spectral envelopes. E.g. amplification factors in an envelope adjusting filterbank are calculated as the square root of the quotients between original signal and transposed signal average power. For this kind of signal, a problem arises: The transposed signal has the same "chord-to-transient" power ratio as the lowband. The gains needed in order to adjust the transposed transients to the correct level thus cause the transposed chords to be amplified relative to the original highband level for the full duration of the envelope data containing transient energy. These momentarily too loud chord fragments are perceived as pre- and post echoes to the transient, see FIG. 1*a*. This kind of distortion will hereinafter be referred to as "gain induced pre- and post echoes". The phenomenon can be eliminated by constantly updating the envelope data at such a high rate that the time between an update and an arbitrarily located transient is guaranteed to be short enough not to be resolved by the human hearing. However, this approach would drastically increase the amount of data to be transmitted and is thus not feasible.

Therefore a new envelope data generation scheme is presented. The solution is to maintain a low update rate during tonal passages, which make up the major parts of a typical programme material, and by means of a transient detector localize the transient positions, and update the envelope data close to the leading flanks, see FIG. 1*b*. This eliminates gain induced pre-echoes. In order to represent the decay of the transients well, the update rate is momentarily increased in a time interval after the transient start. This eliminates gain induced post-echoes. The time segmenting during the decay is not as crucial as finding the start of the transient, as will be explained later. In order to compensate for the smaller time steps, larger frequency steps can be used during the transient, keeping the data size within limits. A non-uniform sampling in time and frequency as outlined above is applicable both on filterbank- and linear prediction-based envelope coding. Different predictor orders may be used for transient and quasi-stationary (tonal) segments.

In case of prediction based coders, no elaborate time/frequency resolution switching schemes are known from prior art. However, some filterbank based coders employ variable time/frequency resolution. This is commonly achieved through switching of the filterbank size. Such a change in size can not take place immediately, so called transition windows are required, and thus the update points can not be chosen freely. When using SBR or any other HFR method, the objective is different—a filterbank can be designed to meet both the highest temporal and highest frequency resolution needed, to extract an adequate envelope representation. Thus, the non-uniform time and frequency sampling of the spectral envelope, can be obtained by adaptive grouping of the subband samples from a fixed size filterbank, into "frequency bands" and "time segments". One envelope sample is then calculated per band and segment. Throughout the description below, "frequency resolution" refers to a specific set of frequency bands, LPC coefficients or similar, used in the envelope estimate for a particular time segment. In other words, from an envelope coding perspective, high frequency resolution or high time resolution can be obtained instantaneously.

From a syntactical point of view, all practical codec bitstreams comprise data periods, each of which corresponds to a short time segment of the input signal. The time segment associated with such a data period, is hereinafter referred to as a "granule". Typical coders use granules of fixed length. The presence of granule boundaries imposes constraints on the design of the time segments used for envelope estimation. The algorithm that generates these time segments, may state that a segment "border" is required at a particular location, and that the subsequent segment should have a certain length. However, if a granule boundary falls within this interval due to fixed length granules, the segment must be split into two parts. This has two implications: First, the number of segments to encode increases, possibly increasing the amount of data to transmit. Second, forced borders may generate segments that are too short for reliable average power estimates. In order to avoid those shortcomings, the present invention uses variable length granules. This requires look-ahead in the encoder, as well as extra buffering in the decoder.

Let the term "grid" denote the time segments and the corresponding frequency resolutions to use for a particular signal, and "local grid" denote the grid of one granule.

Clearly, the grid must be signalled to the decoder for correct decoding of the envelope samples. However, in low bitrate applications the number of bits for this "control signal" must be kept at a minimum. Two signalling schemes are proposed in the present invention. Prior to describing them in detail, a "baseline system" and some design criteria are established.

Let the time quantization step for the spectral envelope be $T_q$. Those steps may be viewed as "subgranules", which are grouped into the aforementioned time segments. In the general case, a granule comprises of S subgranules, where S varies from granule to granule. The number of possible segment combinations within a granule, ranging from one segment for the entire granule to S segments, is given by $$C = \sum_{n=0}^{S} \binom{S}{n} = 2^S \quad \text{(Eq 1)}$$

In order to signal C states, ceil ($\ln_2$ (C))=ceil ($\ln_2$ ($2^S$))=S bits are required, corresponding to one bit per subgranule. An arbitrary subdivision of the granule can be signalled by S−1 bits, representing the consecutive subgranules, stating whether a leading segment border is present at the corresponding subgranule or not. (The first and last granule borders need not be signalled here.) Since S is variable it must be signalled, and if this scheme is combined with a fixed length granule lowband codec, the position relative the constant length granules must be signalled as well. The segment frequency resolutions can be signalled with dynamically allocated control bits, e.g. one bit per segment. Clearly, such a straight forward method may lead to an unacceptable high number of control signal bits.

As will be shown below, many of the states described by Eq. 1 are not very likely, and would also generate too large amounts of envelope data to be practical at a limited bitrate.

The minimum time-span between consecutive transients in music programme material can be estimated in the following way: In musical notation, the rhythmic "pulse" is described by a time signature expressed as a fraction A/B, where A denotes the number of "beats" per bar and 1/B is the type of note corresponding to one beat, for example a ¼ note, commonly referred to as a quarter note. Let t denote the tempo in Beats Per Minute (BPM). The time per note of type 1/C is then given by $$T_n=(60/t)*(B/C)[s] \quad \text{(Eq 2)}$$

Most music pieces fall within the 70–160 BPM range, and in 4/4 time signature the fastest rhythmical patterns are for most practical cases made up from 1/32 or 32:nd notes. This yields a minimum time $T_{nmin}=(60/160)*(4/32)=47$ ms. Of course lower time periods than this may occur, but such fast sequences (>21 events per second) almost get the character of buzz and need not be fully resolved.

The necessary time resolution Tq must also be established. In some cases a transient signal has its main energy in the highband to be reconstructed. This means that the encoded spectral envelope must carry all the "timing" information. The desired timing precision thus determines the resolution needed for encoding of leading flanks. Tq is much smaller than the minimum note period Tnmin, since small time deviations within the period clearly can be heard. In most cases however, the transient has significant energy in the lowband. The above described gain-induced pre-echoes must fall within the so called pre- or backward masking time $T_m$ of the human auditory system in order to be inaudible. Hence $T_q$ must satisfy two conditions:

$$T_q \ll T_{nmin} \quad \text{(Eq 3)}$$

$$T_q < T_m \quad \text{(Eq 4)}$$

Obviously $T_m < T_{nmin}$ (otherwise the notes would be so fast that they could not be resolved) and according to ["Modeling the Additivity of Nonsimultaneous Masking", Hearing Res., vol. 80, pp. 105–118 (1994)], $T_m$ amounts to 10–20 ms. Since $T_{nmin}$ is in the 50 ms range, a reasonable selection of $T_q$ according to Eq 3 results in that the second condition is also met. Of course the precision of the transient detection in the encoder and the time resolution of the analysis/synthesis filterbank must also be considered when selecting $T_q$.

Tracking of trailing flanks is less crucial, for several reasons: First, the note-off position has little or no effect on the perceived rhythm. Second, most instruments do not exhibit sharp trailing flanks, but rather a smooth decay curve, i.e. a well defined note-off time does not exist. Third, the post- or forward masking time is substantially longer than the pre-masking time.

To summarize, the following simplifications can be made with no or little sacrifice of quality for practical signals:

1. Only the transient start position needs to be transmitted with the highest precision $T_q$.
2. Only transients separated by Tp>>Tq need to be fully resolved in the envelope data.

In order to reduce the signalling overhead, both systems according to the present invention employ two time sampling modes; uniform and non-uniform sampling in time. The uniform mode is used during quasi-stationary passages, whereby fixed length segments are used, and little extra signalling is required. In the vicinity of transients, the system switches to non-uniform operation and granules of variable length are used, enabling a good fit to the ideal global grid.

Class Signalling System

Figure 2A:
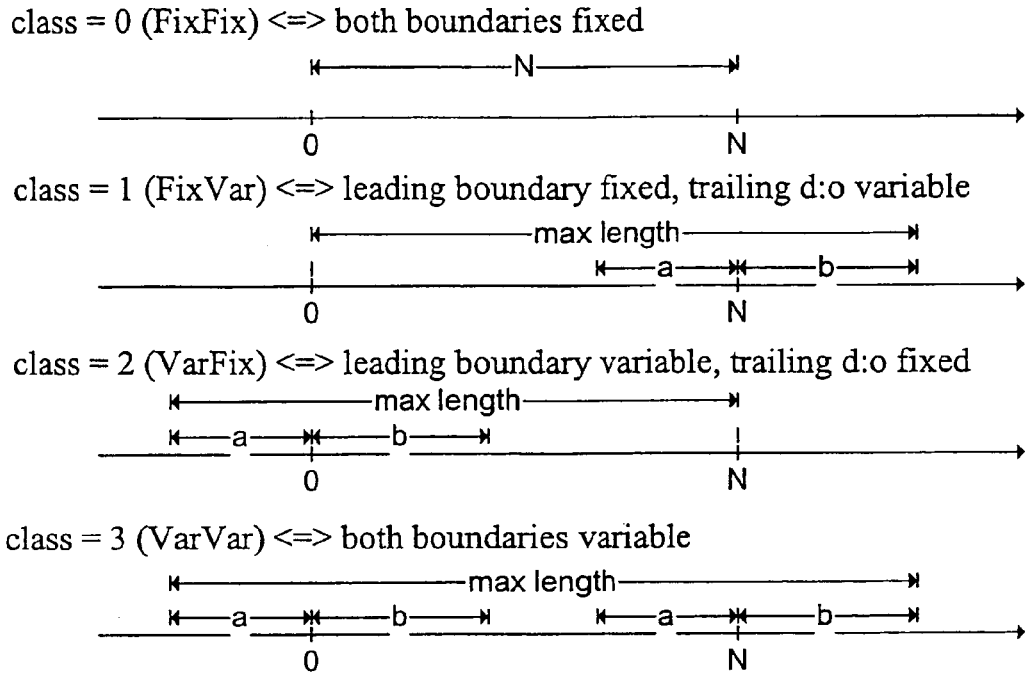
FIGS. 2*a*–2*b* define, and illustrate usage of four classes of granules.

In the first system the granules are divided into four classes, and the control signals are tailored towards the specific needs of each class. The classes are defined in FIG. 2*a*. Class "FixFix" corresponds to conventional constant length granules. Class "FixVar" has a movable stop boundary, which allows the granule length to vary. Class "VarFix" has a variable start boundary, whereas the stop border is fixed. The last class, "VarVar", has variable boundaries at both ends. All variable boundaries can be offset −a/+b versus the "nominal positions".

Figure 2B:
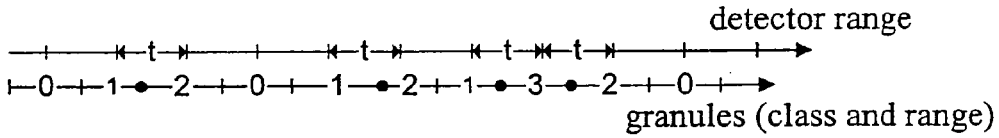

FIG. 2*b* gives an example of a sequence of granules. The system defaults to class FixFix. A transient detector (or psycho-acoustical model) operates on a time region ahead of the current granule, as outlined in the figure. When a transient is detected, a class FixVar granule is used—the system switches from uniform to non-uniform operation. Typically, this granule is followed by a class VarFix granule, since transients most of the time are separated by a number of granules for all practical selections of granule lengths. In case of transients in consecutive frames, the VarVar class frames may be used.

Figure 3A:
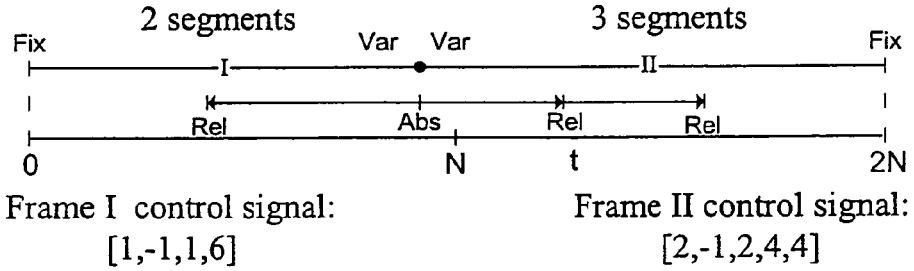
FIGS. 3*a*–3*b* are two examples of granules, and the corresponding control signals.

FIG. 3*a* is an example of a class FixVar—VarFix pair, and the corresponding control signal. One transient is present, and the leading flank (quantized to Tq) is denoted by t. The first part of the bitstream is the "class" signal. Since four classes are used, two bits are used for this signal. In case of FixVar or VarFix classes, the next signal describes the location of the variable boundary, expressed as the offset from the nominal position. This boundary is referred to as the "absolute border". The segment borders within the granules are described by means of "relative borders": The absolute border is used as a reference, and the other borders are described as cumulative distances to the reference. The number of relative borders is variable, and is signalled to the decoder, after the absolute border. A zero number means that the granule comprises one time segment only. Thus, in case of class FixVar, the segment lengths are signalled in a reversed sequence, moving away from the absolute border at the end of the granule. The length of the first segment in a FixVar granule is derived from the relative borders and the total length, and is not signalled. Class VarFix relative border signals are inserted into the bitsream in a forward sequence, whereby the last segment length is excluded. The bitstream signal order is identical to that of class FixVar, that is: [class, abs. border, number of rel. borders, rel. border 0, rel. border 1, . . . , rel. border N−1] In the figure, the signals are shown in "clear text" instead of the actual binary code words sent in the bitstream.

Figure 3B:
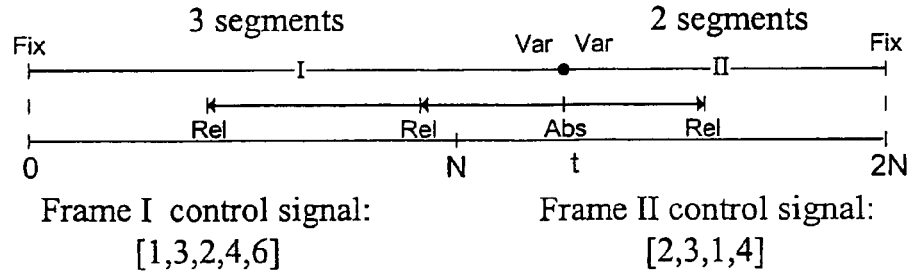

FIG. 3*b* shows an alternative coding of the signal. The variable boundary offers versatility when grouping the segments at a given global grid. Thus some payload control can be performed at this level, e.g. to equalize the number of bits per granule. This may ease the operation of the lowband encoder. Given enough look-ahead, a multipass encoding can be performed, and the optimum combination of local grids be used.

In order to reduce the symbol set for signalling of relative borders, and thereby the number of bits per symbol, those lengths can be quantized to an integer multiple (>1) of Tq, if the absolute border has the precision Tq. In this case the absolute border, in addition to the above function, serves to align a group of borders around the transient with the precision Tq. In other words, the highest precision is always available for coding of transient leading flanks, and a coarser resolution is used in the tracking of the decay.

The VarVar class frames use a combination of the FixVar and VarFix signalling, e.g. interleaved: [class, abs. bord. left, d:o right, num. rel. bord left, d:o right, [rel. bord. left 0, . . . , rel. bord. left N−1], [d:o right]]. This class offers the greatest flexibility in the local grid selection, at the cost of an increased signalling overhead. Finally, the FixFix class does not require other signals than the class signal per se, in which case for example two (equal length) segments are used. However, it is feasible to add a signal that enables selection within a set of predefined grids. For example, the spectral envelope can be calculated for two segments, and if the two envelopes do not differ more than a certain amount, only one set of envelope data is sent.

So far, only the segmenting in time has been described. For many reasons, it may be desirable to signal to the decoder which of the borders that corresponds to a transient leading edge. This can be accomplished by sending a "pointer" that points to the relevant border. The reference direction can follow that of the relative borders, and a zero value imply that no transient start is present within the current granule. Furthermore, the frequency resolution (number of power estimates or predictor order) used for the individual segments must also be defined. This can be signalled explicitely, as in the "baseline system", or implicitely, i.e. the resolution is coupled to the segment lengths, and possibly the pointer position.

When using error prone transmission channels, it is important to avoid error propagation. In the above system, the local grid is fully described by the control signal of the corresponding granule. Hence, no inter-frame dependencies exist in the control signal. This means that the granule boundaries are "overencoded", since the granule intersections are signalled in both consecutive granules. This redundancy can be used for simple error detection—if the borders do not match up, a transmission error has occurred, and error concealment could be activated.

Position Signalling System

Figures 4A, 4B, 4C:
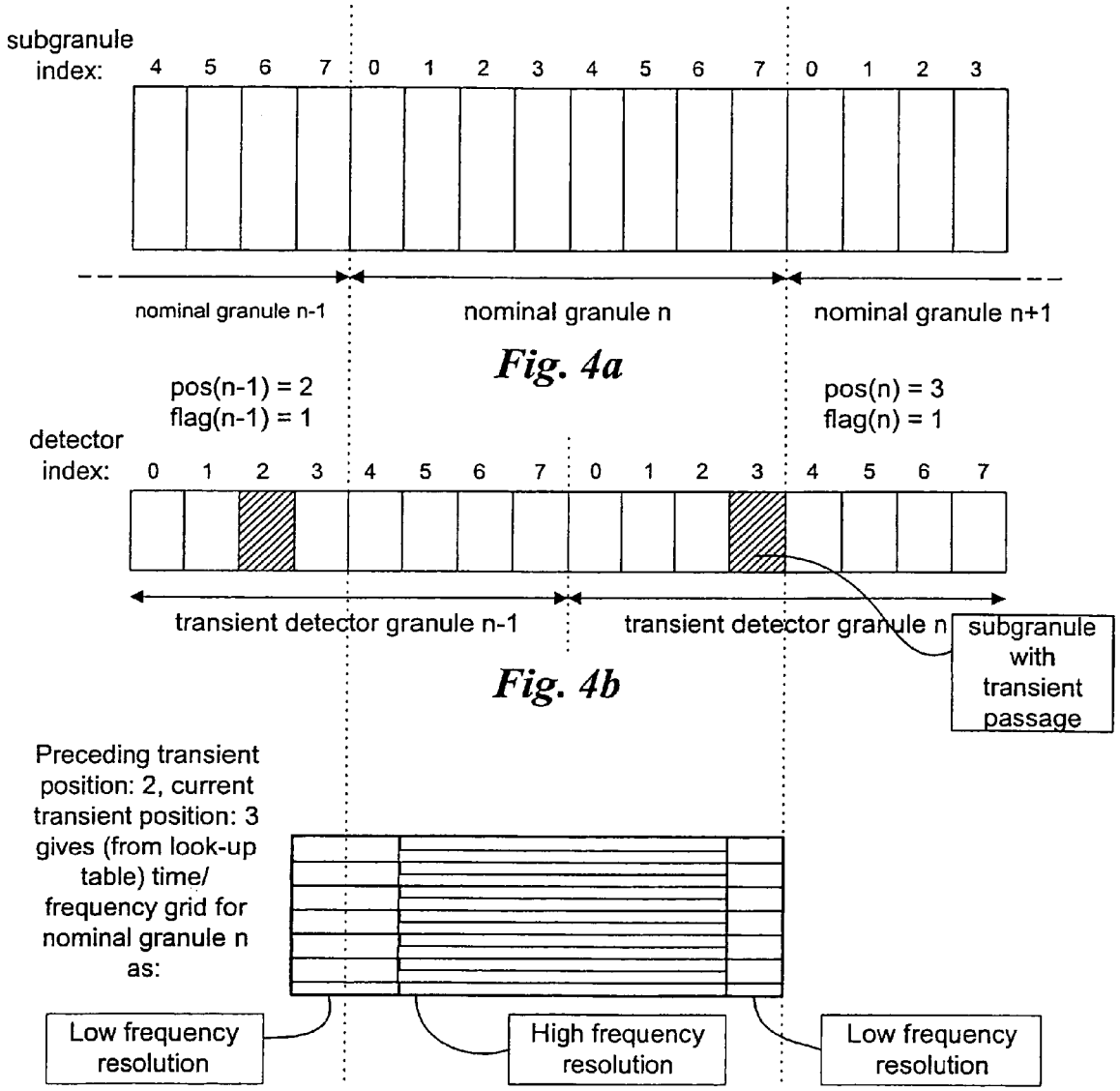
FIGS. 4*a*–4*c* illustrate the position signalling system.

The second system, hereinafter referred to as the "position-signalling system", is intended for very low bitrate applications. The previously established design rules are used to a greater extent, in order to reduce the number of control signal bits even further. According to the present invention, the transient start information can be used for implicit signalling of segment borders and frequency resolutions in the vicinity of transients. This will now be described, assuming a nominal granule size of N subgranules, selected according to $NT_q <= T_{nmin}$, i.e. a maximum of one transient is likely to occur within a granule, see FIG. 4*a*, where N=8. A transient detector, operating on intervals of length N, located N/2 ahead of the current granule, is employed, FIG. 4*b*. When a transient is detected, a flag associated with this region is set. In the example, the transient detector has detected a transient in subgranule 2 at time n−1, and a transient in subgranule 3 at time n. These positions, pos(n−1) and pos(n), as well as the corresponding flags,flag(n−1) and flag(n), are used as input to the grid generation algorithm, and the corresponding local grid for granule n might be as shown in FIG. 4*c*. As seen from the figure, subgranule 3 of the granule at time n−1 is included in the time/frequency grid of granule n. The only signals fed to the bitstream, are flag(n) [1 bit], and pos(n) [ceil($\ln_2$ (N)) bits]. The grid algorithm is also known by the decoder, hence those signals, together with the corresponding signals of the preceding granule n−1, are sufficient for unambiguous reconstruction of the grid used by the encoder. When no transient is detected, the position signal is obsolete, and can be replaced, for example by a 1 bit signal, stating whether one or two segments are used. Thus, uniform mode operation is identical to that of the class signalling system.

This system may be viewed as a finite state machine, where the above described signals control the transitions from state to state, and the states define the local grids. Clearly, the states can be represented by tables, stored in both the encoder, and the decoder. Since the grids are hard coded, the ability to adaptively alter the payload has been sacrificed. A reasonable approach is to keep the time/frequency data matrix size (e.g. number of power estimates) approximately constant. Assuming that the number of scalefactors or coefficients in a high resolution segment is two times that of a low resolution segment, one high resolution segment can be traded for two low resolution segments.

Time/Frequency Switched Scalefactor Encoding

Utilising a time to frequency transform it can be shown that a pulse in the time domain corresponds to a flat spectrum in the frequency domain, and a "pulse" in the frequency domain, i.e. a single sinusoidal, corresponds to a quasi-stationary signal in the time domain. In other words a signal usually shows more transient properties in one domain than the other. In a spectrogram, i.e. a time/frequency matrix display, this property is evident, and can advantageously be used when coding spectral envelopes.

Figure 5:
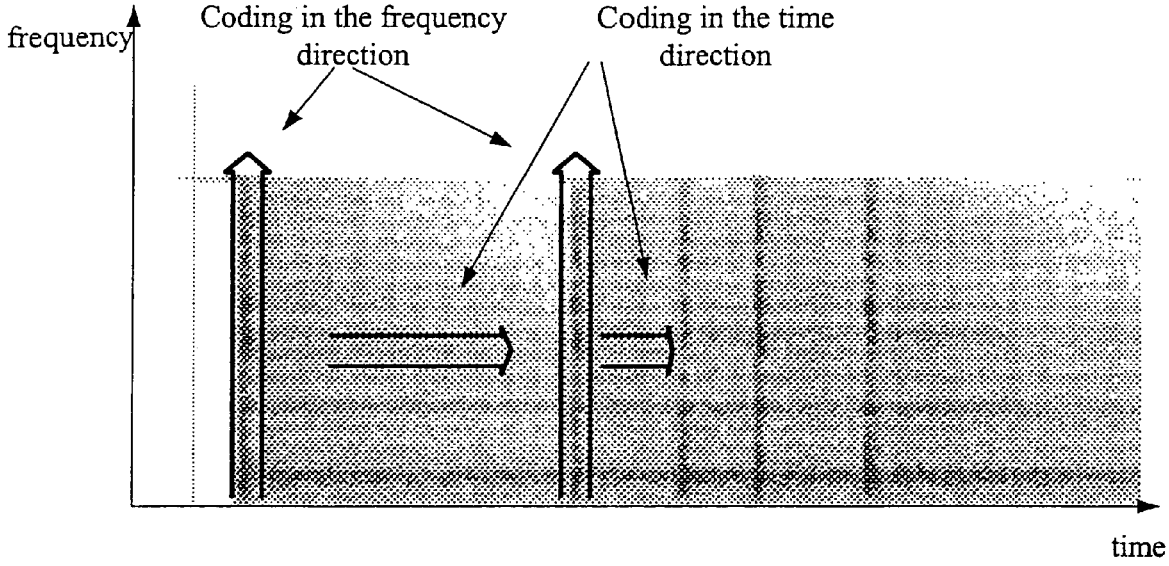
FIG. 5 illustrates time/frequency switched delta coding.

A tonal stationary signal can have a very sparse spectrum not suitable for delta coding in the frequency-direction, but well suited for delta coding in the time-direction, and vice versa. This is displayed in FIG. 5. Throughout the following description a vector of scale factors calculated at time n0 represents the spectral envelope $$Y(k,n_0)=[a_1,a_2,a_3,\ldots,a_k,\ldots,a_N], \quad \text{(Eq 5)}$$

where a1 . . . aN are the amplitude values for different frequencies. Common practice is to code the difference between adjacent values in the frequency-direction at a given time, which yields:

$$D(k,n_0)=[a_2-a_1,a_3-a_2,\ldots,a_N-a_{(N-1)}]. \quad \text{(Eq 6)}$$

In order to be able to decode this, the start value a1 needs to be transmitted. As stated above this delta-coding scheme can prove to be most inefficient if the spectrum only contains a few stationary tones. This can result in a delta coding yielding a higher bit rate than regular PCM coding. In order to deal with this problem, a time/frequency switching method, hereinafter referred to as T/F-coding, is proposed: The scalefactors are quantized and coded both in the time- and frequency-direction. For both cases, the required number of bits is calculated for a given coding error, or the error is calculated for a given number of bits. Based upon this, the most beneficial coding direction is selected.

As an example, DPCM and Huffman redundancy coding can be used. Two vectors are calculated, $D_f$ and $D_t$:

$$D_f(k,n_0)=[a_2-a_1,a_3-a_2,\ldots,a_N-a_{(N-1)}], \quad \text{(Eq 7)}$$

$$D_t(k,n_0)=[a_1(n_0)-a_1(n_0-1),a_2(n_0)-a_2(n_0-1),\ldots,a_N(n_0)-a_N(n_0-1)] \quad \text{(Eq 8)}$$

The corresponding Huffman tables, one for the frequency direction and one for the time direction, state the number of bits required in order to code the vectors. The coded vector requiring the least number of bits to code represents the preferable coding direction. The tables may initially be generated using some minimum distance as a time/frequency switching criterion.

Start values are transmitted whenever the spectral envelope is coded in the frequency direction but not when coded in the time direction since they are available at the decoder, through the previous envelope. The proposed algorithm also require extra information to be transmitted, namely a time/frequency flag indicating in which direction the spectral envelope was coded. The T/F algorithm can advantageously be used with several different coding schemes of the scalefactor-envelope representation apart from DPCM and Huffman, such as ADPCM, LPC and vector quantisation. The proposed T/F algorithm gives significant bitrate-reduction for the spectral-envelope data.

Practical Implementations

Figure 6:
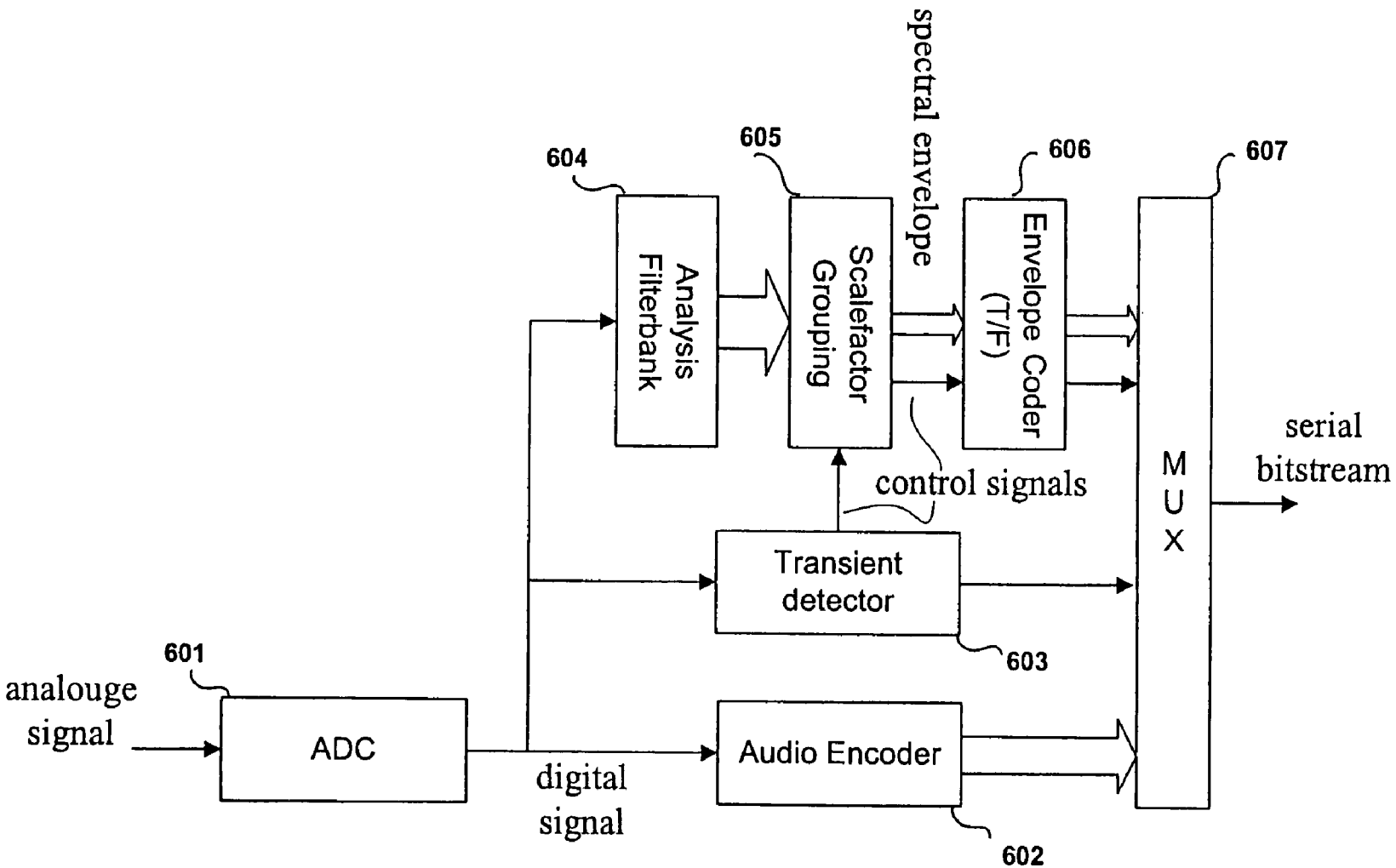
FIG. 6 is a block diagram of an encoder using the envelope coding according to the invention.

An example of the encoder side of the invention is shown in FIG. 6. The analogue input signal is fed to an A/D-converter 601, forming a digital signal. The digital audio signal is fed to a perceptual audio encoder 602, where source coding is performed. In addition, the digital signal is fed to a transient detector 603 and to an analysis filterbank 604, which splits the signal into its spectral equivalents (subband signals). The transient detector could operate on the subband signals from the analysis bank, but for generality purposes it is here assumed to operate on the digital time domain samples directly. The transient detector divides the signal into granules and determines, according to the invention, whether subgranules within the granules is to be flagged as transient. This information is sent to the envelope grouping block 605, which specifies the time/frequency grid to be used for the current granule. According to the grid, the block combines the uniform sampled subband signals, to form the non-uniform sampled envelope values. As an example, these values may represent the average power density of the grouped subband samples. The envelope values are, together with the grouping information, fed to the envelope encoder block 606. This block decides in which direction (time or frequency) to encode the envelope values. The resulting signals, the output from the audio encoder, the wideband envelope information, and the control signals are fed to the multiplexer 607, forming a serial bitstream that is transmitted or stored.

Figure 7:
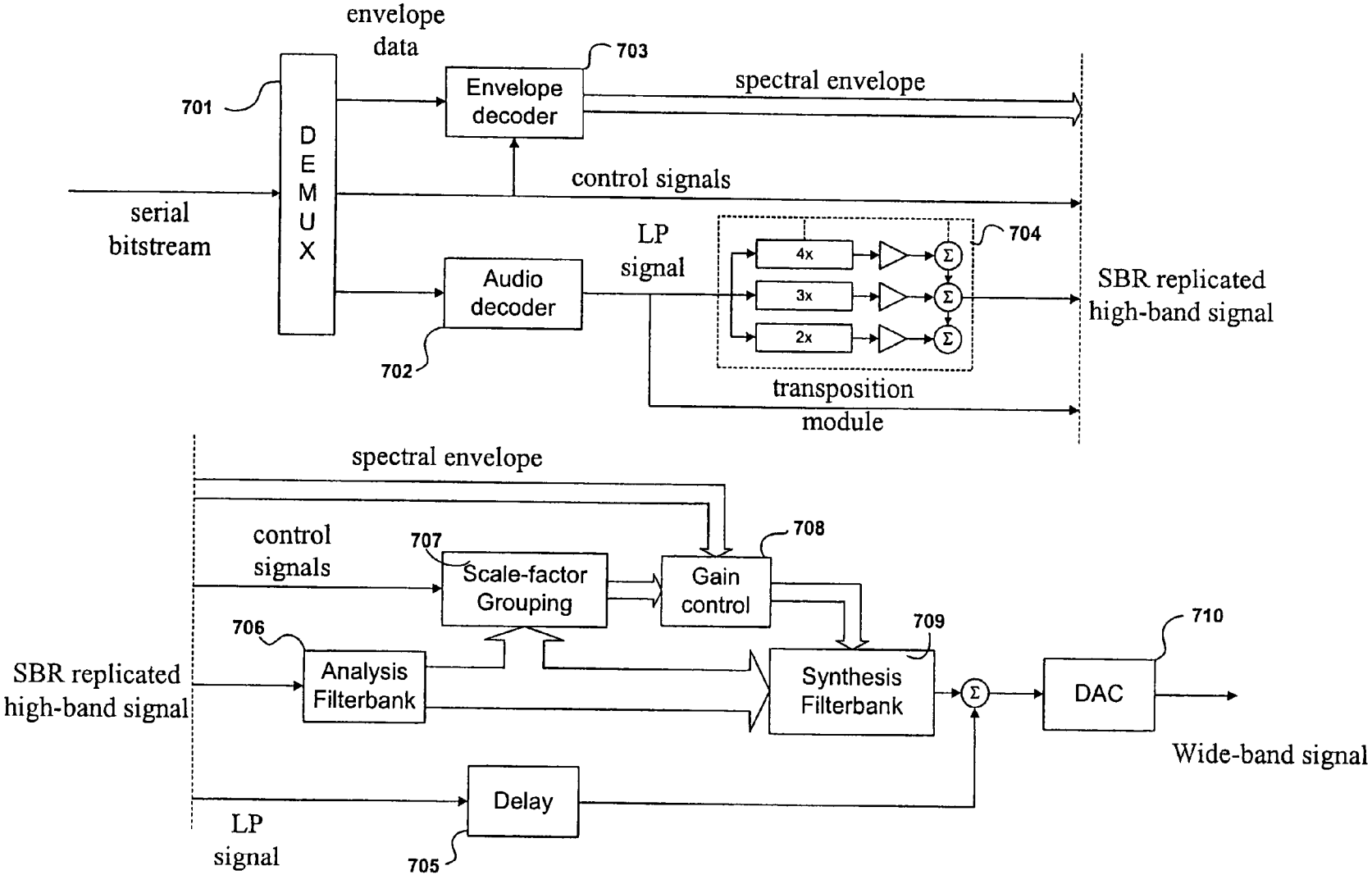
FIG. 7 is a block diagram of a decoder using the envelope coding according to the invention.

The decoder side of the invention is shown in FIG. 7, using SBR transposition as an example of generation of the missing residual signal. The demultiplexer 701 restores the signals and feeds the appropriate part to an audio decoder 702, which produces a low band digital audio signal. The envelope information is fed from the demultiplexer to the envelope decoding block 703, which, by use of control data, determines in which direction the current envelope are coded and decodes the data. The low band signal from the audio decoder is routed to the transposition module 704, which generates a replicated high band signal from the low band. The high band signal is fed to an analysis filterbank 706, which is of the same type as on the encoder side. The subband signals are combined in the scalefactor grouping unit 707. By use of control data from the demultiplexer, the same type of combination and time/frequency distribution of the subband samples is adopted as on the encoder side. The envelope information from the demultiplexer and the information from the scalefactor grouping unit is processed in the gain control module 708. The module computes gain factors to be applied to the subband samples before recombination in the synthesis filterbank block 709. The output from the synthesis filterbank is thus an envelope adjusted high band audio signal. This signal is added to the output from the delay unit 705, which is fed with the low band audio signal. The delay compensates for the processing time of the high band signal. Finally, the obtained digital wideband signal is converted to an analogue audio signal in the digital to analogue converter 710.

What is claimed is:

1. A method for spectral envelope coding in a source encoder, and wherein the source encoder is operative to exclude a residual signal corresponding to certain frequency regions from transmitted or stored data, comprising the following step:

performing a statistical analysis of the input signal, based on the outcome of the analysis, selecting a grid to be used in a spectral envelope representation, generating data representing the spectral envelope, by using the grid, transmitting or storing the data together with a control signal describing the grid, wherein the step of selecting is performed such that the grid includes granules of variable length, the granules selected in the step of selecting including a granule having a variable start boundary or a variable stop boundary, and wherein the control signal includes information on the variable start boundary or the variable stop boundary.

2. The method according to claim 1, in which the step of selecting is performed such that the grid further includes a granule having a fixed start boundary or a fixed stop boundary.

3. The method according to claim 1, in which the step of selecting is performed such that the granules are granules out of four classes of granules, wherein the first class has fixed position granule boundaries, the second class has a fixed position start boundary, and a variable position stop boundary, the third class has a variable position start boundary, and a fixed position stop boundary, and the fourth class has variable position start and stop boundaries.

4. The method according to claim 3, in which the fixed positions coincide with reference positions, separated by the distance L, and the variable positions are offset by −a, +b versus the reference positions, a and b being variable numbers.

5. The method according to claim 3, in which the control signal includes two bits for a granule, the two bits signaling one class of the four classes selected for the granule.

6. The method of claim 1, in which the step of selecting is performed for selecting a grid having a granule having fixed boundaries followed by a granule having a fixed position start boundary and a variable position stop boundary followed by a granule having a variable position start boundary and a fixed position stop boundary.

7. The method of claim 1, in which the step of performing the statistical analysis is performed using a look-ahead method operating on a time region ahead of a current granule.

8. The method on claim 1, in which the control signal is such that variable granule boundaries are signaled in integer multiples of $T_q$, wherein Tq is selected to be smaller than 10–20 ms.

9. The method of claim 2, in which the grid is selected to have two granules having a fixed length, and wherein the step of generating generates data representing the spectral envelopes for the two granules, and wherein, in the step of transmitting, only data for one granule is sent or stored, when envelopes for the two granules do not differ more than a certain amount.

10. The method of claim 1, in which the control signal includes a pointer pointing to a border of a granule corresponding to a transient leading edge.

11. The method of claim 1, in which the control signal includes an explicit or implicit indication for a frequency resolution used for a granule.

12. An apparatus for encoding of a spectral envelope of a signal to be decoded by a decoder, comprising:

an analyzer for performing a statistical analysis of an input signal, a selector for selecting an instantaneous time or frequency resolution to be used in a spectral envelope representation of the input signal, based on the outcome of the analysis, a generator for generating of data representing the spectral envelope, using the resolution, and a transmitter or storing device for transmitting or storing the data together with a control signal describing the resolution, wherein the selector is operative to select a grid including granules of variable length, the granules selected in the step of selecting including a granule having a variable start boundary or a variable stop boundary, and wherein the control signal includes information on the variable start boundary or the variable stop boundary.

13. An apparatus for decoding an encoded spectral envelope of a signal, the encoded spectral envelope being encoded using a grid including granules of variable length, the granules including a granule having a variable start boundary or a variable stop boundary, the encoded spectral envelope including a control signal having information on the variable start boundary or the variable stop boundary, the apparatus comprising:

an interpreter for interpreting the control signal in order to determine an instantaneous time or frequency resolution used in the spectral envelope of the signal, the interpreter being operative for determining the variable start boundary or the variable stop boundary of the granule;

a decoder for decoding the encoded spectral envelope for the granules having a variable length, using the variable start boundary or the variable stop boundary of a granule; and a user for using decoded spectral envelope data obtained by the decoder in a synthesis of an output signal.

14. A method for decoding an encoded spectral envelope of a signal, the encoded spectral envelope being encoded using a grid including granules of variable length, the granules including a granule having a variable start boundary or a variable stop boundary, the encoded spectral envelope including a control signal having information on the variable start boundary or the variable stop boundary, the method comprising:

interpreting the control signal in order to determine an instantaneous time or frequency resolution used in the spectral envelope of the signal, the interpreter being operative for determining the variable start boundary or the variable stop boundary of the granule;

decoding the encoded spectral envelope for the granules having a variable length, using the variable start boundary or the variable stop boundary of a granule; and using decoded spectral envelope data obtained by the step of decoding in a synthesis of an output signal.

* * * * *